United States Patent [19]

Kaczerginski et al.

[11] 4,414,429

[45] Nov. 8, 1983

[54] END CAP ATTACHMENT TO LAMINATED INSULATOR CORE

[75] Inventors: Alexandre Kaczerginski, Bellerive sur Allier; Michel Willem, Vichy, both of France

[73] Assignee: Societe Anonyme dite: Ceraver, Paris, France

[21] Appl. No.: 343,290

[22] Filed: Jan. 27, 1982

[30] Foreign Application Priority Data

Feb. 5, 1981 [FR] France ..... 81 02206

[51] Int. Cl.[3] ..... H01B 17/02; H01B 17/38

[52] U.S. Cl. ..... 174/179; 174/140 S; 174/186

[58] Field of Search ..... 174/140 S, 176, 177, 174/178, 179, 186, 188, 189

[56] References Cited

U.S. PATENT DOCUMENTS 3,534,989 10/1970 Yonkers ..... 174/176 X 4,127,741 11/1978 Bauer et al. ..... 174/179 X 4,316,054 2/1982 Willem ..... 174/179 X

FOREIGN PATENT DOCUMENTS 1921299 11/1970 Fed. Rep. of Germany ..... 174/179

1097222 2/1955 France ..... 174/179

*Primary Examiner*—Laramie E. Askin

*Attorney, Agent, or Firm*—Kenyon & Kenyon

[57] ABSTRACT

An insulator core made of an organic substance and including a central rod (1) fitted with an insulating covering (4) is fixed in a metal cap (8) which is not machined.

The end of the rod has undercut zones such as circumferential channels (10) or double cones (9), and a ductile metal cup (5) whose edges are made integral with the insulating covering (4) in a sealed manner is crimped on the rod. The cup (5) is itself embedded in the cap (8) by means of an organic cement or embedding substance (7) which is reinforced.

10 Claims, 9 Drawing Figures

END CAP ATTACHMENT TO LAMINATED INSULATOR CORE

BACKGROUND OF THE INVENTION

The present invention relates to attaching end caps to an insulator having a laminated core made of an organic substance. The invention is particularly applicable to suspended insulators or line post insulators but it is also applicable to phase spacers and cross pieces.

Such an insulator comprises both an elongate core including at least one rod made of agglomerated fibers, and at least one fixing cap which has a core receiving and embedding recess in which one end of the core is fixed. Outside the recess the rod is protected by a covering such as an elastomer sheath which may be provided with fins.

Preferred embodiments of the present invention provide an insulator in which the means for fixing the rod in the cap are capable of withstanding high mechanical forces without requiring the cavity of the cap to be complex in shape or carefully and expensively machined.

SUMMARY OF THE INVENTION

The present invention provides an insulator comprising a pair of fixing caps and an elongate core, made of organic material, which includes a rod made of agglomerated fibers, one of said caps being fitted each end of the core, with the core being covered in between the caps by a protective covering of insulating material, and each cap having a core-receiving recess supplied with embedding substance, wherein at least one end of the core has undercut fixing zones and is provided with a ductile metal cup which is crimped directly onto said end, with the rim of the cup being sealed to said covering of insulating material, said cup itself being embedded in a core-receiving cap recess by means of said embedding substance.

Said undercut zones may be in the form of double cones, channels or a screw thread for example. They may be moulded on the end of the rod. In all cases, their function is to form a fixing means.

The outside surface of the cup is preferably covered with a layer that does not adhere to cement, e.g. a varnish.

The edges of the cup may be glued or crimped to said insulating covering.

BRIEF DESCRIPTION OF THE DRAWINGS

Embodiments of the invention are described by way of example with reference to the accompanying drawings in which.

Figure 7:
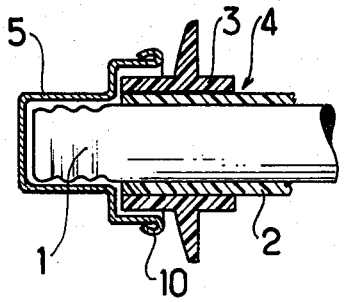
Figure 8:
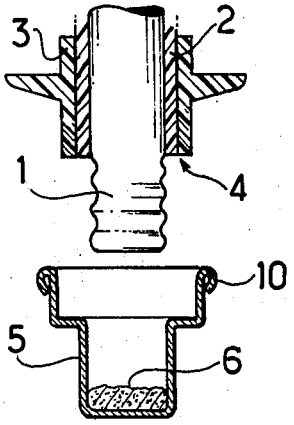
Figure 9:
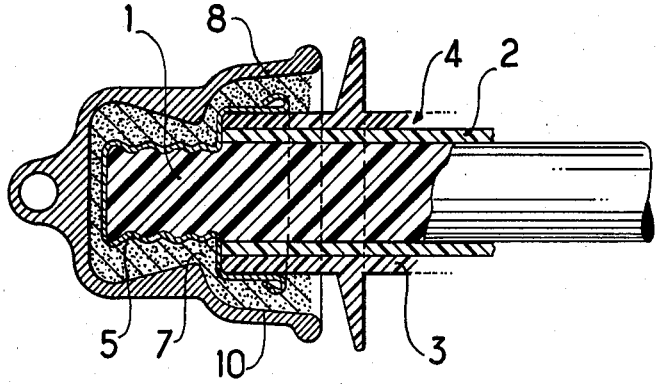

FIG.. 6 is a diagrammatic cross-section through a cup;

FIGS. 7 and 8 are diagrammatic cross-sections showing two steps during assembly of a cup on the end of a rod; and FIG. 9 is a cross-section through the end of an insulator in accordance with the invention.

DETAILED DESCRIPTION

Figure 1:
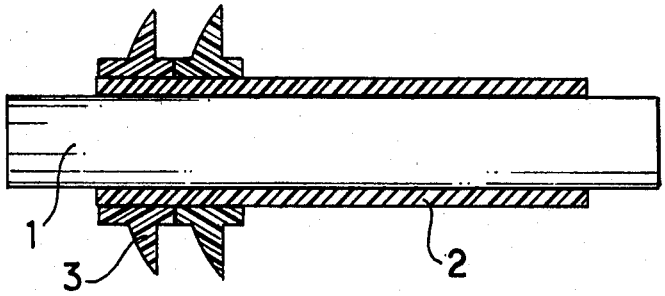
FIGS. 1 and 2 are two partial diagrammatic cross-sections through two types of core for insulators in accordance with the invention.
Figure 3:
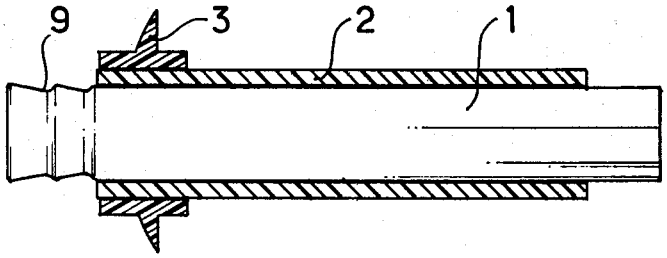
FIGS. 3, 4, and 5 show variant undercut zones on rods for insulators in accordance with the invention.

As illustrated in FIG. 1, the core of an insulator has a rod 1 made of longitudinal glass fibers and polymerized resin. The central portion of said rod 1 is either covered with an elastomer sheath 2 and with elastomer fins 3 or with elastomer fins 13 only (FIG. 3). In either case, with or without a sheath, the fins form a resilient sealed covering by means of glueing, welding, casting or injection. The elastomer may be e.g. EPDM (ethylene-propylene-diene monomer), silicones, epoxy, or polyurethane.

Figure 4:
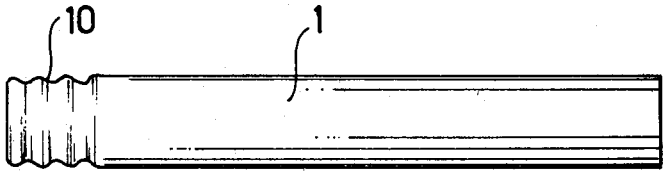
Figure 5:
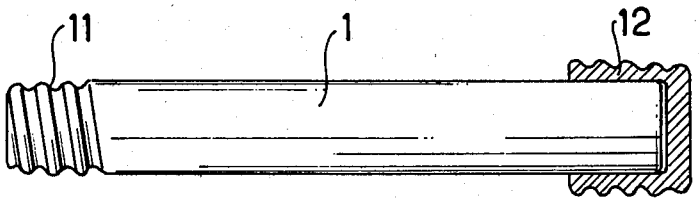

To constitute the fixing means in accordance with the invention, the end of the rod is machined at either end of the aforementioned central elastomer covering so as to form one or a plurality of double cones 9 (FIG. 3) or circumferential channels 14 (FIG. 4) or, even, screw threads 11 (left-hand end of FIG. 5). These channels or cones can also be added to the rod by moulding (see 12, right-hand end of FIG. 5), casting or surface moulding.

Figure 6:
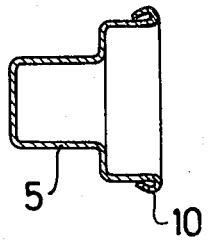

A thin stepped cap 5 made of ductile metal such as aluminum is then fitted on the end of the rod (FIG. 6). For electrical reasons, the rim of the cup 5 is preferably curled over at 10 so as not to form a sharp ridge adjacent the edge of the cap. The end portion situated near the inner end of said cup is substantially cylindrical, and its inside diameter is one tenth to a few tenths of a millimeter greater than the maximum diameter of the machined end portion of the rod, while the diameter of the stepped portion of the rod, while the diameter of the stepped portion situated near the edge is one tenth to a few tenths of a millimeter greater than the diameter of the cylindrical end part of the elastomer covering.

FIG. 7 shows a rod end with circumferential channels. If the rod has a screw thread, the cup could also have a screw thread so as to be able to screw it onto the rod.

The cup 5 is made to adhere to the covering 4, e.g., by the method illustrated in FIG. 8. The rod 1 is placed vertically, and a sufficient quantity of glue 6 is poured into the cup 5 before fitting the cup on the lower end of the rod 1 and the covering 4. The glue then rises and coats the inner surface of the cup 5 and the outer surface of the covering 4. The excess glue is driven out through the end of the cup on subsequent crimping. This way of glueing makes it possible to keep air away from the neighborhood of the sleeve. This is a great advantage.

The cup 5 is then crimped both to the rod 1 and to the covering 4 by a method such as hydrostatic pressing or magnetic forming, for example.

The cup 5 and the covering 4 are thus sealed by both crimping and glueing, the crimping thereby making glueing more efficient.

Lastly, the cup 5 is embedded in a cap 8 (see FIG. 9) by means of an inorganic or organic cement mortar 7, by using an economic, reliable and known method.

The smooth condition of the outside surface of the cup 5, possibly further improved by an anti-adhesive treatment, allows the rod 1 and its cup 5 to move relative to the hardened mortar 7 when a tractive force (which is the usual type of force) is exerted on the insulator. This develops radial compression stresses in the rod 1 via the cup 5, which stresses considerably increase the shearing strength of the rod 1 in its fixing zone.

Said possibility of relative movement between the cap 8 and the cup 5 can be further increased by applying an anti-adhesive treatment to the inside of the cap 8 previous to embedding.

Further, when a bending force is applied, the circumferential channels or the double cones of the rod which are formed by machining and are reproduced on the cup by crimping prevent the portion of the rod under tension in the fixing means from separating from the portion of the rod under compression, when the insulator is subjected to a bending moment.

We claim:

1. An insulator comprising a pair of fixing caps and an elongate core which includes a rod made of agglomerated fibers, one of said caps being fitted at each end of the core, and a protective covering of insulating material surrounding the rod between the caps, and each cap having a core-receiving recess supplied with embedding substance, wherein at least one end of the core has undercut fixing zones, and a ductile metal cup is crimped directly onto said end, said cup having a rim which is sealed to said covering of insulating material, said cup itself being embedded in the corresponding core-receiving cap recess by means of said embedding substance.

2. An insulator according to claim 1, wherein said undercut zones are double cones.

3. An insulator according to claim 1, wherein said undercut zones are channels.

4. An insulator according to claim 1, wherein said undercut zones form a screw thread.

5. An insulator according to claim 1, wherein said undercut zones are moulded on the end of the rod.

6. An insulator according to claim 1, wherein the rim of said cup is also crimped to said insulating covering.

7. An insulator according to claim 1, wherein said embedding substance is selected from the group consisting of cement mortar and an organic compound.

8. An insulator according to claim 1, wherein the outside wall of said cup is covered with an anti-adhesive layer.

9. An insulator according to claim 1, wherein the inside wall of said recess is covered with an anti-adhesive layer.

10. An insulator according to any one of the preceding claims, wherein said cup is bonded to said end of the rod while its edges are bonded to said covering.

* * * * *

UNITED STATES PATENT AND TRADEMARK OFFICE

CERTIFICATE OF CORRECTION

PATENT NO. : 4,414,429

DATED : 8 November 1983

INVENTOR(S) : Alexandre KACZERGINSKI and Michel WILLEM

Figure 2:
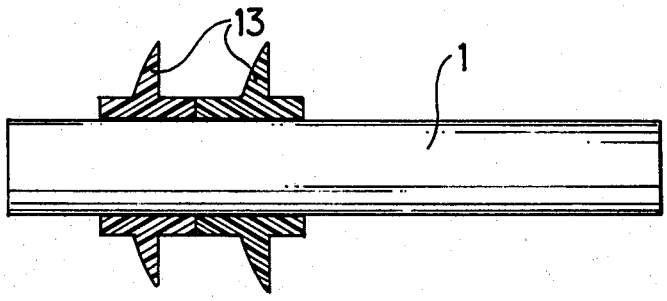

It is certified that error appears in the above—identified patent and that said Letters Patent is hereby corrected as shown below:

Column 2, line 7: change "(Fig. 3)" to --(Fig. 2)--.

Signed and Sealed this

*Thirteenth* Day of *March 1984*

[SEAL]

*Attest:*

GERALD J. MOSSINGHOFF

*Attesting Officer*

*Commissioner of Patents and Trademarks*